United States Patent [19]

Bakker et al.

[11] 4,010,083

[45] Mar. 1, 1977

[54] METHOD OF LOCAL ELECTROPLATING OF STRIP MATERIAL

[75] Inventors: Martinus Antonius Maria Bakker; Leonardus Henricus Klerks, both of Eindhoven, Netherlands

[73] Assignee: U.S. Philips Corporation, New York, N.Y.

[22] Filed: May 28, 1975

[21] Appl. No.: 581,576

[52] U.S. Cl. ..... 204/15; 204/224 R

[51] Int. Cl.[2] ..... C25D 5/02; C25D 5/06

[58] Field of Search ..... 204/224 R, 15, 28

[56] References Cited

UNITED STATES PATENTS

| | | | |
|---|---|---|---|
| 883,756 | 4/1908 | Steiner | 204/26 |
| 936,472 | 10/1909 | Pfanhauser | 204/206 |
| 2,591,042 | 4/1952 | Berman et al. | 204/206 |
| 3,374,159 | 3/1968 | Poole | 204/224 R |
| 3,661,752 | 5/1972 | Capper et al. | 204/206 |

FOREIGN PATENTS OR APPLICATIONS

| | | | |
|---|---|---|---|
| 331,930 | 5/1903 | France | 204/224 R |
| 493,108 | 9/1938 | United Kingdom | 204/224 |
| 760,016 | 10/1956 | United Kingdom | 204/224 R |

*Primary Examiner*—T. M. Tufariello
*Attorney, Agent, or Firm*—Frank R. Trifari; Norman N. Spain

[57] ABSTRACT

Local electroplating of strip material by means of a cylinder which is non-conductive at its surface and wets the workpiece and by means of at least one separate anode. The strip material is preferably fed in a direction parallel to the axis of the cylinder.

1 Claim, 2 Drawing Figures

METHOD OF LOCAL ELECTROPLATING OF STRIP MATERIAL

Figure 1:
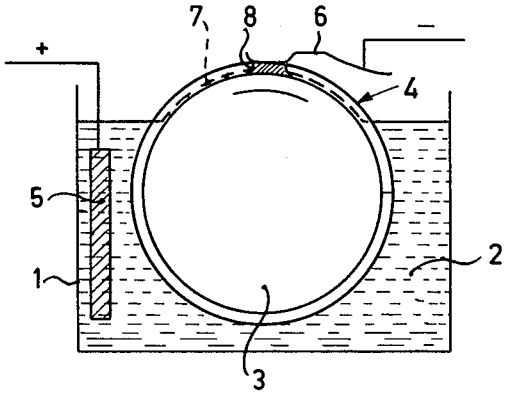

The invention relates to a method of local electroplating of strip material and to an apparatus for carrying out this method.

Such a method is described, inter alia in British Patent Specification No. 14,091 A.D. 1909, in which strip material, connected as the cathode, is electroplated outside an electrolyte tank and in contact with a rotating cylinder which is continuously wetted with a liquid electrolyte and itself wets the strip material with liquid electrolyte. Such a cylinder is connected as an anode and is covered with a layer of porous electrically non-conductive material capable of absorbing the electrolyte. Because the rotating cylinder is continuously wetted, for example by partly dipping in the tank of electrolyte, the electrolyte is continuously renewed and deposition is highly uniform.

This method may be modified so that deposition is effected locally only, as described in German Patent Application No. 2,010,139 laid open to public inspection.

The later method has become highly attractive owing to the scarcity and cost of some metals, such as gold, platinum, rhodium, and the like, because it provides appreciable saving in such a material. In many types of electric contact springs or contact pins in which a noble metal is used because of its high resistance to chemical attack, in present-day technology the noble metal is provided at the contact face only, the remainder of the spring or pin being made of a cheaper material of less high quality. The contact springs or pins are joined to form a strip, which after the electroplating treatment is divided.

The method described of the local electroplating of material was found to have serious disadvantages in practice. Thus, the porous anode-cylinder cover which is impregnated with liquid electrolyte proved to provide less renewal than is required for even electroplating.

In addition a very serious disadvantage is provided by the anode products which are produced simultaneously with the desired deposit and may inadvertably contaminate it so as to adversely affect the properties or the appearance of the deposit. In cyanide containing gold baths, for example, products such as cyanates and malonic acid dinitrile may be produced. As a result, the gold coating shows blisters, it becomes porous and less resistant to corrosion. Free oxygen which may be evolved impairs the current efficiency and may also spoil the deposit.

The invention provided a considerably improved method of local electroplating of strip material in which the strip material, which is connected as the cathode, is locally wetted with liquid electrolyte in contact with, or close to, a rotating cylinder located outside of the electrolyte tank which is continuously wetted with liquid electrolyte. The method according to the invention is characterized in that the rotating cylinder at least at its surface is electrically non-conductive and in that at least one anode in the electrolyte tank is electrolytically connected to the strip material connected as the cathode only through the liquid electrolyte present on the cylinder surface.

Obviously in this method, in which the anode is separated from the point of contact of the strip material with a film of liquid on the surface of the cylinder, the anode products are separately produced and cannot contaminate the deposit on the material. Consequently the product obtained by the method is of particularly high quality. A great advantage is also that high current densities can be used.

In a further elaboration of the method according to the invention the strip material is moved in a direction parallel to the axis of the wetting cylinder. Hitherto the material was fed forward in a direction at right angles to the axis. The advantage of this novel feed in a direction parallel to the axis is that the profile of the deposit can be varied at will with respect to thickness and to location. The strip material is in contact with the film of liquid on the cylinder during a time which depends upon the speed of feed, which enables the amount of deposite per unit length of the strip to be determined. The location of the deposite is controlled by the choice of the point of contact with the strip. The profile of the deposite can further be influenced by means of the speed of rotation and the direction of rotation of the cylinder and the location of the anode.

In the apparatus for carrying out the method according to the invention the cylinder, at least at the side at which the strip material is fed forward, has a locally increased diameter. As a result the advancing strip material is wetted by the liquid electrolyte. The strip material retains the film of liquid by capillarity at the location at which the cylinder has its normal diameter and hence along this part of its travel is not in direct contact with the cylinder. This greatly reduces wear of the cylinder and of the deposit.

Figure 2:
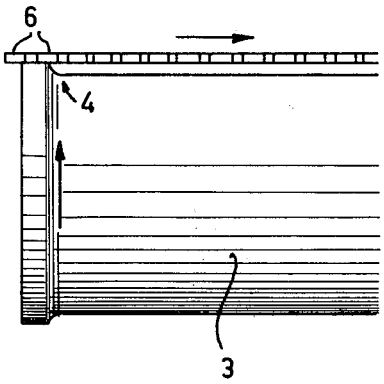

An embodiment of the invention will now be described, by way of example, with reference to the accompanying diagrammatic drawings, in which:

FIG. 1 is a cross-sectional view of an apparatus according to the invention, and FIG. 2 is a side elevation thereof.

Referring now to the Figures, a tank 1 is filled with a liquid electrolyte 2. The tank accommodates a rotating cylinder 3 the speed of which is variable and the surface of which consists, for example, of a polyamide or polypropylene. The cylinder at one end has an edge 4 of increased diameter. An anode 5 is disposed in the tank. The workpiece to be electroplated, in the case under consideration a batch of contact springs 6 which are united to form a continuous strip, it disposed outside the tank. The rotating cylinder entrains a surface film 7 from the liquid, and between the batch of contact springs 6 and the cylinder a given amount of liquid electrolyte 8 is retained by capillarity.

In a practical embodiment the cylinder has a diameter of 50 mm and a length of 1 mm. At one end the cylinder has a raised edge 1 of height 1 mm and length 5 mm. In the apparatus, springs united to form a strip are gold-plated using a current density of about 10 A/cm² in a conventional gold-plating bath heated at a temperature between 50° and 70° C. The speed of the cylinder is 200 revolutions per minute, the speed of the strip is 1 m per minute.

What is claimed is:

1. A method of electroplating selected portions of a strip material, comprising bringing the desired portions of the strip material, connected as a cathode, in contact only with an electroplating solution present on the surface of a rotating cylinder, the surface at least of which is electrically non-conducting, while moving said strip material along the axis of said cylinder and while said rotating cylinder is partially immersed in a tank containing the electroplating solution and an anode separated from said cylinder, in a manner such that the axis of said cylinder is substantially parallel to the surface of the electroplating solution in the tank.

* * * * *